US005123753A

United States Patent [19]

Waugh

[11] Patent Number: 5,123,753

[45] Date of Patent: Jun. 23, 1992

[54] BAG AND FASTENING MEANS THEREFOR

[75] Inventor: Adrian G. Waugh, West Lancashire, England

[73] Assignee: Richard Hoyle, Lancashire, England

[21] Appl. No.: 615,584

[22] Filed: Nov. 19, 1990

[51] Int. Cl.[5] ..... A65D 27/00

[52] U.S. Cl. ..... 383/86; 383/29; 383/31

[58] Field of Search ..... 383/29, 31, 71, 86, 383/119; 150/110; 190/902; 224/236-240, 250, 255

[56] References Cited

U.S. PATENT DOCUMENTS

| | | | |
|---|---|---|---|
| 1,731,547 | 10/1929 | Stansbury | 190/902 |
| 1,940,900 | 12/1933 | Barnard | 190/902 |
| 2,128,693 | 8/1938 | Dowd | 383/86 |
| 2,431,030 | 11/1947 | Edwards | 383/86 |
| 3,425,470 | 2/1969 | Wuest | 150/110 |
| 3,889,872 | 6/1975 | Lin | 383/71 |
| 3,943,988 | 3/1976 | Consorti | 383/86 |
| 4,177,909 | 12/1979 | Haskell . | |
| 4,445,230 | 4/1984 | Spadaro . | |
| 4,648,121 | 3/1987 | Lowe | 383/86 |
| 4,930,697 | 6/1990 | Takahashi et al. | 383/119 |

FOREIGN PATENT DOCUMENTS

| | | | |
|---|---|---|---|
| 168521 | 9/1921 | United Kingdom . | |
| 857878 | 1/1961 | United Kingdom . | |
| 2029692 | 3/1980 | United Kingdom . | |
| 1574312 | 9/1980 | United Kingdom . | |
| 2218684 | 11/1989 | United Kingdom | 383/86 |

*Primary Examiner*—Gary E. Elkins
*Attorney, Agent, or Firm*—Anthony J. Casella; Gerald E. Hespos

[57] ABSTRACT

A laundry bag is provided with a first loop on a wall of the bag on one side of an aperture and a second loop on a wall of the bag on the opposite side of the aperture. An elongate strap extends perpendicularly from the vicinity of the second loop. In use, the strap may be passed successively through the first and second loops and pulled tightly, whereupon the aperture is securely closed, to a variable degree. Also disclosed is a similar arrangement for use with a laundry bag which has a closure flap for covering the aperture and wherein the strap and the second loop are affixed to the closure flap.

27 Claims, 2 Drawing Sheets

BAG AND FASTENING MEANS THEREFOR

BACKGROUND OF THE INVENTION

1. Field of the Invention

The present invention relates to a bag, in particular, but not exclusively, to a laundry bag, and to fastening means therefor.

There are many forms of laundry container available. In the past, laundry has been packaged in wicker baskets and metal boxes but linen bags or hampers have proved the most favourable since they are cheap to produce, are easy to clean and sterilise and can be stored simply.

However, whilst there are a variety of linen bags and hampers on the market, each type has its drawbacks. The most common drawback with the known bags or hampers is their method of fastening.

It is important that the laundry, whether it is being collected or being returned, is retained in its bag or hamber since dirty or soiled washing can be a health risk, but more importantly as a means of transportation. Obviously it is equally important that clean washing should remain clean.

2. Description of the Prior Art

Known problems with current securing means fall into a variety of categories, and result from the requirement that the bags or hampers themselves must be regularly laundered to keep the contents clean.

Hook and loop fasteners such as VELCRO (VELCRO is a registerd Trade Mark) attract fibres during washing and are soon rendered ineffective.

Zips have been found to be too easily damaged during washing and are expensive to replace.

Buckles and belts have similarly been found to sustain mechanical damage during laundering.

Press studs get damaged during the washing process and soon become inoperable. Furthermore, unless they are made of expensive material, they rust and mark laundry.

Eyelets suffer from similar deficiencies to studs and the cord used in securing the bag is liable to fray and break (e.g. by abuse such as cutting).

SUMMARY OF THE INVENTION

In accordance with a first aspect of the present invention, there is provided a container comprising one or more containing walls defining an aperture and a containing volume, and closure means for closing the aperture comprising a first loop attached to the exterior of the container, a second loop attached to the exterior of the container and a strap connected to the container in the vicinity of the second loop and being adapted to pass successively through the first and second loops to close the aperture.

Preferably, the strap is connected to the container between the first and second loops. Advantageously, the second loop is located on the opposite side of the aperture from the first loop.

In one embodiment, the container comprises a closure flap for positioning across the aperture to close the container. Preferably, the strap is located on the closure flap, preferably along a free edge thereof. The second loop may advantageously be located on the closure flap, preferably on the exterior surface thereof.

In an alternative embodiment, the first and second loops may be located on opposite sides of the aperture, and the strap may be connected to a wall between the aperture and the second loop.

In accordance with a second aspect of the present invention there is provided a container comprising one or more enclosing walls which define a containing volume and a closure flap for closing the container, the container further comprising fastening means comprising a first loop on a wall of the container, a second loop on the closure flap and a strap extending from one of the closure flap and the side wall, the strap being adapted to pass successively through the loop located on the other of the closure flap and the said wall, and the remaining loop, to fasten the closure flap in a closed condition.

In accordance with a third aspect of the present invention, there is provided a container comprising one or more containing walls defining an aperture and a containing volume, and closure means for closing the aperture comprising a first loop attached to the exterior of the container, a second loop attached to the exterior of the container on the opposite side of the aperture from said first loop, and a strap connected to the container in the vicinity of the second loop and being adapted to pass successively through the first and second loops to close the aperture.

In accordance with a fourth aspect of the present invention there is provided a fastening means for closing an aperture of a container having one or more enclosing walls defining the said aperture and a containing volume, comprising a first loop for attachment to a wall of the container, a second loop for attachment to a wall of the container and a strap for connection to the container in the vicinity of the second loop, the strap being adapted to pass successively through the first and second loops to close the aperture.

It has been found that this bag and fastening means prove of particular benefit for laundry containers since the alleviate the problems associated with traditional methods of fastening.

In one embodiment the strap may be attached to the container.

Alternatively, the strap may be an integral part of the container.

Preferably, the container is made of a strong, lightweight material which readily compacts. The bag could be made from natural or man-made fibre, for example cotton or nylon, or a combination of natural and man-made fibres.

The loops are preferably sewn onto the bag in appropriate positions. The first loop may be sewn onto the container, e.g. onto a closure flap and the second loop may be sewn onto a front wall of the container opposite the side on which the closure flap is secured to the bag.

BRIEF DESCRIPTION OF THE DRAWINGS

By way of example only, a specific embodiment of the present invention will be described with reference to and as illustrated in the accompanying drawings, in which.

DESCRIPTION OF THE PREFERRED EMBODIMENTS

Figure 1:
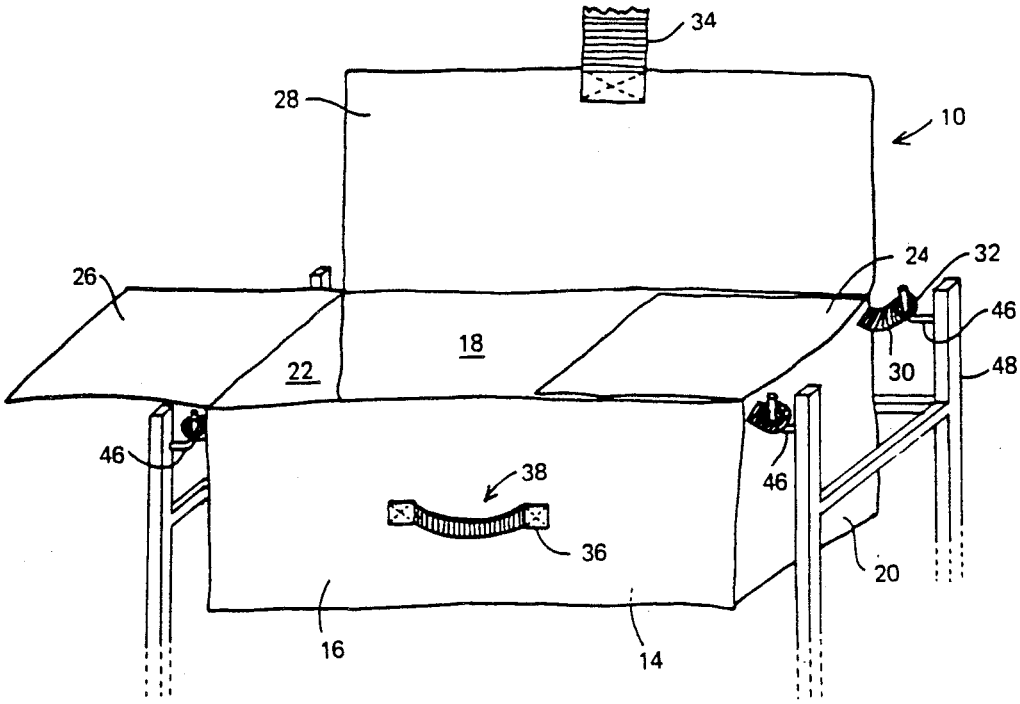
FIG. 1 is a perspective view of a first embodiment of laundry bag hung on a support frame and having a fastening means, in accordance with the invention.
Figure 4:
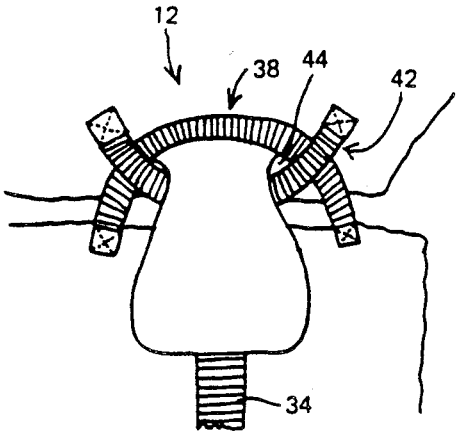
FIG. 4 is a detailed view of the fixing means shown in a secured position.
Figure 5:
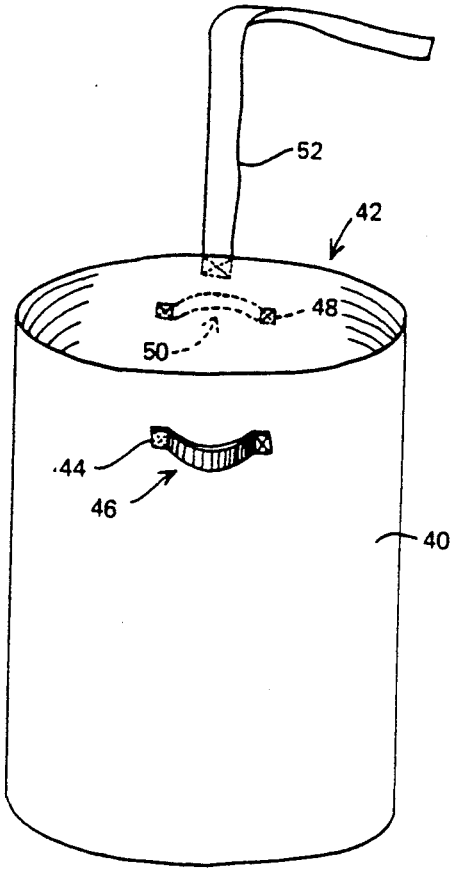
FIG. 5 is a perspective view of a second embodiment of laundry bag having a fastening means, in accordance with the present invention.

FIG. 1 shows a cuboidal laundry bag 10, commonly referred to as a laundry hamper, having a fastening means 12 (shown separately in FIG. 4). The laundry bag 10 is formed of polyester and comprises a base 14, (not visible) front and rear walls 16 and 18, and two side walls 20 and 22 which extend from the base 14. Extending from the two side walls 20 and 22 are two fold-across flaps 24 and 26 and extending from rear wall 18 is a closure flap 28.

The bag is conveniently made from material which is cut and stitched to form a bag defined as above. Attached to each of four corners of the bag where the side walls and front and rear walls intersect remote from the base are short straps 30, each having a metal eyelet 32. These straps provide means for mounting the bag on hooks 46 of a support frame 48.

The fastening means 12 for releasably securing the closure flap 28 over the aperture defined by walls 16, 18, 20 and 22 comprises an elongate strap 34 of nylon webbing which is firmly stitched to the inner surface of the leading edge of the closure flap 28 such that it extends substantially perpendicularly to the leading edge, a short piece of webbing 36 such as seat belt webbing which is stitched at either end to the front wall 16 to form a first loop 38 and a second short piece of nylon webbing 40 which is stitched at either end to the exterior surface of the closure flap 28 to form a second loop 42.

When the bag has been filled with laundry, the side flaps 24 and 26 are folded over the open bag and the closure flap 28 is then folded over the side flaps 24 and 26.

The closure flap 28 is then secured over the open bag. This securing can be carried out to a variety of degrees.

Figure 2:
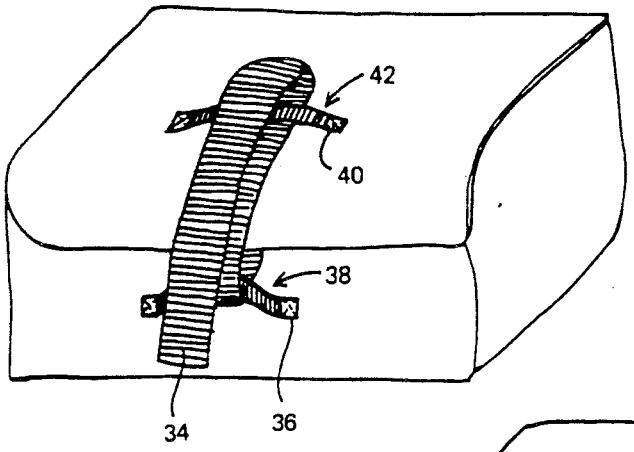
FIG. 2 is a perspective view of a laundry bag of FIG. 1 fitted with the fastening means of the invention in a threaded position.

Firstly, the strap 34 is pulled through the first loop 38 in a direction towards the base 14 of the bag. The strap 34 is then looped upwardly, back over loop 38 and passed through the second loop 42 in a direction towards the rear wall 18. The strap 34 is then looped back over the loop 42 and is pulled in a direction towards the base 14. This secures, albeit somewhat loosely, the closure flap 28 over the opening defined by the walls 16, 18, 20 and 22 (see FIG. 2).

Figure 3:
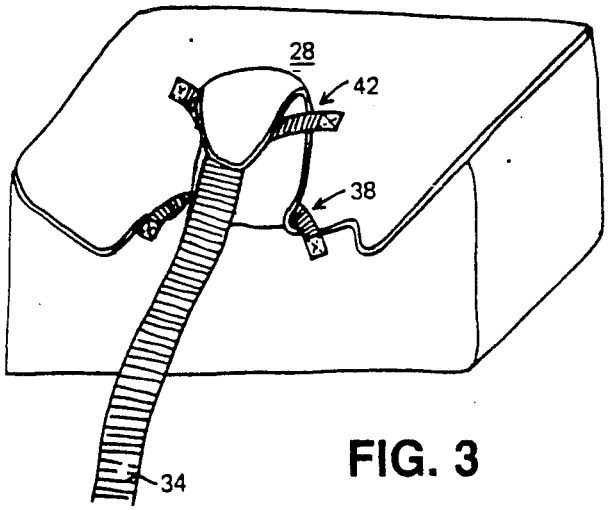
FIG. 3 is a perspective view of the laundry bag fitted with the fastening means of the invention shown in a semi-secured position.

By further pulling on the strap 34, part of the actual closure flap material 28 is drawn through first loop 38 and then through second loop 42. The added bulk of this material provides for greater friction between the closure flap 28 and the first and second loops 38 and 42 thereby producing a more secure fitting (see FIG. 3).

Finally, by pulling the strap 34 tight, the first and second loops 38 and 42 interengage with the foremost part of the flap material such that a third loop 44 is defined by the first and second loops where they cross (see FIG. 4), and thus the cover flap 28 is locked firmly to the front wall 16.

Preferably, the cover flap 28 is of a size larger from front to back than the base. This provides an excess of material which can be pulled through the loops to aid securing the cover flap to the front wall.

The strap 34 can be an extension of the closure flap 28 or a separate entity affixed thereto. It does not have to be elongate, and may be, for example, in the form of a triangle.

The second embodiment, illustrated in FIGS. 5 to 8, is in the form of a tubular polyester cloth container having tubular side walls 40, a circular base (not visible) and an open upper end 42, commonly referred to as a laundry bag. A piece 44 of strong webbing, such as the webbing used for vehicle seat belts, is stitched at each end to the exterior surface of the tubular wall of the bag to form a first fastening loop 46. A second indentical piece 48 of webbing is stitched at each end to the exterior surface of the tubular wall of the bag in a position diametrically opposed to the first loop 46, to form a second fastening loop 50. An elongate strap of strong webbing 52, such as the webbing used for vehicle seat belts, is stitched at one end to the exterior surface of the bag, above the second loop 50, adjacent the periphery of the open end of the bag.

Figure 6:
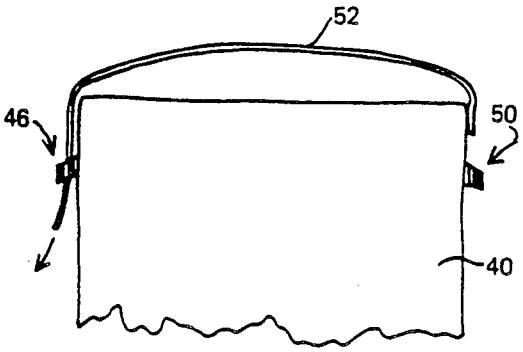
FIGS. 6 to 8 are side views of the upper portion of the bag of FIG. 5, in various stages of securing.
Figure 7:
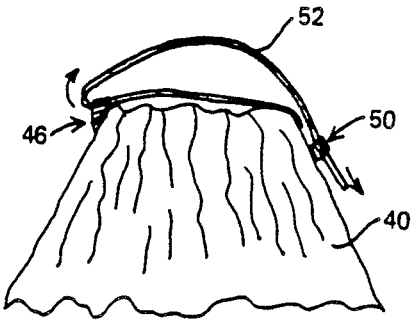
Figure 8:
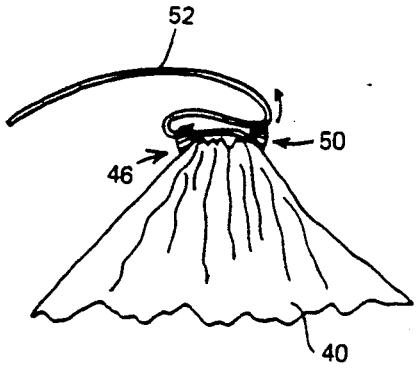

When the laundry bag is full, the strap 52 and loops 46, 48 are used to secure the bag. Firstly, as shown in FIG. 6, the strap 52 is passed across the open upper end of the bag and through the first loop 46. The strap is then looped upwardly, back over the first loop 46, over the open end of the bag and down through the second loop 50, as illustrated in FIG. 7, which also shows that this action causes the open end of the bag to be partially closed, due to the deformation of the bag material as a result of the pulling of the strap 52. The strap 52 is then looped upwardly, back over the open end of the bag, as shown in FIG. 8, causing the two loops to be drawn closer to each other.

By pulling the strap 52 tight, the first and second loops interengage as in the first embodiment with the portion of the bag wall 40 in the region of the attachment of the strap 52, such that a third loop is defined by the first and second loops 46, 50 where they cross. The friction involved in such an attachment ensures that it will not accidentally loosen.

As can be seen, the open end of the bag can be closed to varying degrees, depending upon the extent to which the strap 52 is pulled.

The fastening means can be used on any form of container which is of relatively deformable material, but it is of particular use on laundry hampers and bags since it provides a simple and effective way of securing a cover piece over a hamper or securing the open end of a bag and has no parts which are easily damaged. Furthermore, replacement of the loops and strap is simple and cheap if damage occurs.

I claim:

1. A laundry bag comprising:

one or more flexible containing walls;

a containing volume and an extrance aperture defined by said containing walls;

a first flexiable loop attached to the exterior of said laundry bag;

a second flexiable loop attached to the exterior of said laundry bag; and a flexible strap attached to said laundry bag in the vicinity of said second loop, the containing walls, the loops and the straps being sufficiently flexible and positioned relative to each other to enable the strap to pass successively through said first and second loops and to cause the loops to overlap or interengage in order to close said aperture.

2. A laundry bag as claimed in claim 1, wherein said strap is connected to said laundry bag between said first and second loops.

3. A laundry bag as claimed in claim 1, wherein said second loop is located on an opposite side of said aperture from said frist loop.

4. A laundry bag as claimed in claim 1, wherein said laundry bag comprises a closure flap for positioning across said aperture to close said laundry bag.

5. A laundry bag as claimed in claim 4, wherein said strap is located on said closure flap.

6. A laundry bag as claimed in claim 5, wherein said strap is located along a free edge of said closure flap.

7. A laundry bag as claimed in claim 4, wherein said second loop is located on said closure flap.

8. A laundry bag as claimed in claim 7, wherein said second loop is located on the exterior surface of said closure flap.

9. A laundry bag as claimed in claim 1, wherein said first and second loops are located on opposite sides of said aperture, and saidd strap is connected to a wall of said laundry bag between said aperture and said second loop.

10. A laundry bag as claimed in claim 1, wherein said containing walls are made from a textile material.

11. A laundry bag as claimed in claim 10, wherein said containing walls comprise polyester.

12. A laundry bag as claimed in claim 1, wherein said strap is made from a textile material.

13. A laundry bag as claimed in claim 1, wherein said first and second loops are made from a textile material.

14. A laundry bag comprising:

one or more flexible containing walls;

a containing volume and an entrance aperture defined by said one or more flexible containing walls;

a flexible closure flap for closing said entrance aperture of said laundry bag;

a first flexible loop located on the exterior of one of said one or more flexible containing walls;

a second flexible loop located on the exterior of said closure flap; and a flexible strap extending from the closure flap or said one of said flexible walls, said containing walls, said loopes, said closure flap and said strap being sufficiently flexible and positioned relative to each other to enable the strap to pass successively through said second loop on said closure flap of said one of said flexible walls from which said strap does not extend and said remaining loop, and to cause the loops to overlap or interengage in order to fasten said closure flap in a closed position.

15. A laundry bag as claimed in claim 14, wherein said strap extends from said closure flap.

16. A laundry bag as claimed in claim 15, wherein said strap is located along a free edge of said closure flap.

17. A laundry bag as claimed in claim 14, wherein said containing walls are made from a textile material.

18. A laundry bag as claimed in claim 17, wherein said containing walls comprise polyester.

19. A laundry bag as clamed in claim 14, wherein said strap is made from a textile material.

20. A laundry bag as claimed in claim 14, wherein said first and second loops are made from a textile material.

21. A laundry bag as claimed in claim 15, wherein said closure flap is sufficiently flexible to enable a portion of it to be pulled through and overlapping or interengaging loops by said strap.

22. A laundry bag comprising:

one or more flexible containing walls;

a containing volume and an entrance aperture defined by said containing walls;

a first flexible loop attached to the exterior of said laundry bag;

a second flexible loop attached to the exterior or said laundry bag, on an opposite side of said entrance aperture from said first loop; and a flexible strap attached to said laundry bag in the vicinity of the second loop, said containing walls, said loops and said strap being sufficiently flexible and positioned relative to each other to enable said flexible strap to pass successively through said first and second loops and to cause the loops to overlap or interengage in order to close said aperture.

23. A laundry bag as claimed in claim 22, wherein said walls of said container are made from a textile material.

24. A laundry bag as claimed in claim 23, wherein said walls of the laundry bag comprise polyester.

25. A laundry bag as claimed in claim 22, wherein said strap is made from a textile material.

26. A laundry bag as claimed in claim 22, wherein said first and second loops are made from a textile material.

27. A laundry bag as claimed in claim 23, wherein each of said containing walls is sufficiently flexiable to enable a portion of said one of said walls to be pulled through said overlapping or interengaging loops by said strap.

* * * * *